US006012418A

United States Patent [19]

Bodenhausen et al.

[11] Patent Number: 6,012,418

[45] Date of Patent: Jan. 11, 2000

[54] DISTRIBUTOR DEVICE FOR FUEL INJECTION SYSTEMS

[75] Inventors: Eckhard Bodenhausen, Steinheim; Thomas Gregorius, Grossbottwar, both of Germany

[73] Assignee: Robert Bosch GmbH, Stuttgart, Germany

[21] Appl. No.: 09/101,824

[22] PCT Filed: Sep. 2, 1997

[86] PCT No.: PCT/DE97/01915

§ 371 Date: Jul. 16, 1998

§ 102(e) Date: Jul. 16, 1998

[87] PCT Pub. No.: WO98/22706

PCT Pub. Date: May 28, 1998

[30] Foreign Application Priority Data

Nov. 18, 1996 [DE] Germany ..... 196 47 586

[51] Int. Cl.[7] ..... F02M 37/04

[52] U.S. Cl. ..... 123/70; 123/531; 123/456

[58] Field of Search ..... 123/456, 468, 123/469, 470, 531, 533

[56] References Cited

U.S. PATENT DOCUMENTS

| | | | |
|---|---|---|---|
| 4,294,215 | 10/1981 | Hans et al. | 123/470 |
| 5,058,554 | 10/1991 | Takeda et al. | 123/456 |
| 5,070,844 | 12/1991 | Daly | 123/468 |
| 5,101,800 | 4/1992 | Schumann et al. | 123/531 |
| 5,115,786 | 5/1992 | Yamada | 123/531 |
| 5,119,792 | 6/1992 | Gu | 123/533 |
| 5,209,204 | 5/1993 | Bodenhausen et al. | 123/470 |
| 5,323,749 | 6/1994 | Gras et al. | 123/470 |
| 5,347,969 | 9/1994 | Gmelin et al. | 123/456 |
| 5,363,825 | 11/1994 | Becker | 123/456 |
| 5,531,202 | 7/1996 | Lorraine | 123/456 |
| 5,598,824 | 2/1997 | Treusch et al. | 123/470 |

FOREIGN PATENT DOCUMENTS

| | | |
|---|---|---|
| 530 337 | 3/1993 | European Pat. Off. . |
| 44 01 013 | 7/1994 | Germany . |
| 44 31 044 | 3/1996 | Germany . |

*Primary Examiner*—Thomas N. Moulis
*Attorney, Agent, or Firm*—Kenyon & Kenyon

[57] ABSTRACT

The present invention relates to a distributor device (1) for fuel injection systems of internal combustion engines for supplying gas and for electrical contacting of fuel injection valves (2).

The distributor device has a gas supply line (70) for the joint gas supply to the fuel injection valves (2), comprising a supply orifice (71) and a number of connecting parts (7) for connecting the supply orifice (71) to gas inlet channels (13) of the fuel injection valves (2). Furthermore, a plurality of bushings (78) are provided along the gas supply line (70) and work together with plugs (47) provided on the fuel injection valves (2) to establish electric contact with the fuel injection valves (2).

In the refinement according to this invention, a locking spring (88) is provided for each bushing (78) to lock the connection of the bushing (78) to the plug (47) of the respective fuel injection valve (2). Furthermore, operating devices (87) for releasing the locking springs (88) are provided on the side (102) of the gas supply line (70) facing away from the bushings (78), where each locking spring (88) runs across the longitudinal extent of the gas supply line (70) as far as the respective operating device (87).

13 Claims, 3 Drawing Sheets

DISTRIBUTOR DEVICE FOR FUEL INJECTION SYSTEMS

The invention relates to a distributor device for fuel injection systems of internal combustion engines for supplying gas and electrically contacting at least two of the fuel injection valves according to the definition of the species of the main claim that serve to inject a mixture of fuel and gas.

Unexamined German Patent DE-OS 44 31 044 has already disclosed a distributor device for fuel injection systems, where several bushings to accommodate plugs arranged on the fuel injection valves are molded onto a gas supply line to the common gas supply of the fuel injection valves. The gas supply line has connecting parts with a branch opening that opens into the supply opening of the gas supply line. Gas inlet channels of the fuel injection valves can be inserted into the branch openings. A bushing strip on which are arranged the bushings for electrically contacting the fuel injection valves runs parallel to the gas supply line. However, in dismantling the known distributor device for maintenance purposes, it has the disadvantage that no easily handled means for releasing the connection between the bushings and the plugs of the injection valves are provided. In comparison with a conventional bushing-plug connection, releasing the connection between the bushings and plugs is subject to special problems inasmuch as the connection between the gas inlet channels of the fuel injection valves and the connecting parts of the gas supply line must also be separated at the same time. Furthermore, no means are provided for compensation of the manufacturing tolerance in the distance between the plugs and the gas inlet channels of the fuel injection valves on the one hand and the bushings and connecting parts of the distributor device on the other hand, although this distance varies only to a very slight extent. This further interferes with handling in both assembly and dismantling.

European Patent 0 530 337 has disclosed a fuel distributor for supplying fuel to the fuel injection valves. The electric supply lines for electrically contacting the fuel injection valves are arranged inside a contact strip which can be placed on the fuel distributor by a snap connection. However, the bushings to be placed on the plugs of the fuel injection valves are not integrated into the fuel distributor but instead are connected to the supply lines running in the contact strip by an external cable. Therefore, connecting the plugs to the bushings does not take place simultaneously with the fuel injection valves being connected to the fuel supply line, but instead it requires an additional assembly step.

ADVANTAGES OF THE INVENTION

The distributor device according to this invention with the characterizing features of the main claim, however, has the advantage that it guarantees simple, inexpensive and easily handled gas supply with integrated electrical contacting of fuel injection valves for injection of a fuel-gas mixture. The distributor device is a very compact component which can be assembled and dismantled very easily. In dismantling the distributor device, the locking connection of the bushing with the plug of the respective fuel injection valves is released by loosening a locking spring. An operating device for loosening the locking spring is arranged on the side of the gas supply line facing away from the bushings. This has the advantage that accessibility of the operating device is not hindered by the fuel injection valve. The arrangement of the operating device directly on the gas supply line has the additional advantage that the operating device is in the immediate vicinity of the connection of the gas inlet channel of the fuel injection valve to the respective connecting part of the gas supply line which must be released at the same time in dismantling the distributor device. In this way the connection between the bushing and the plug and that between the gas inlet channels and the distributor device can be released at the same time with a simple measure, which greatly simplifies handling.

Advantageous refinements and improvements on the distributor device characterized in the main claim are possible through the measures characterized in the subclaims.

It is especially advantageous if the connecting parts of the gas supply line have sealing bodies of an elastic material surrounding the gas inlet channels of the fuel injection valves at least partially radially after their insertion into the connecting parts. Two functions are achieved simultaneously, namely a sealing effect and, because of the elastic design of the sealing body, compensation of the tolerance in the distance between the gas inlet channel and the plug. This compensation of tolerance is especially important in practice, because the manufacture of fuel injection valves and of distributor devices is subject to manufacturing variations within very narrow tolerances. However, even a minor deviation in the distance between the bushing and the connecting part on the distributor device in comparison with the distance between the plug and the gas inlet channel on the fuel injection valve to be used in the distributor device can lead to difficulty in handling during assembly. The elastic design of the sealing body surrounding the gas inlet channel leads to a satisfactory compensation of tolerance because of the floating mount of the gas inlet channel.

The electric supply lines can be carried on the outside of the wall of the gas supply channel to particular advantage, for which purpose special clamping elements can be provided. If an electric supply line, e.g., the ground line, is to be connected to all the bushings, then trough-shaped elements which may be provided on the distributor device to accommodate the branches in this common electric supply line may be cast in a hard-setting plastic resin after producing the electric connection for the branch. The branches are thus secured mechanically as well as being electrically insulated in an advantageous manner.

DRAWING

Embodiments of the invention are shown in simplified form in the drawing and are explained in greater detail in the following description. The figures show:

FIG. 1: a sectional view of a distributor device according to this invention mounted on a fuel injection valve;

FIG. 2: a detail of a view of the distributor device according to this invention as seen from the side of the fuel injection valve;

FIG. 3: a partially cutaway schematic diagram of a fuel injection valve on which can be mounted the distributor device according to this invention;

FIG. 4: a simplified longitudinal view of the distributor device as seen on the side of the distributor device facing away from the fuel injection valves.

DESCRIPTION OF THE EMBODIMENTS

Figure 1:
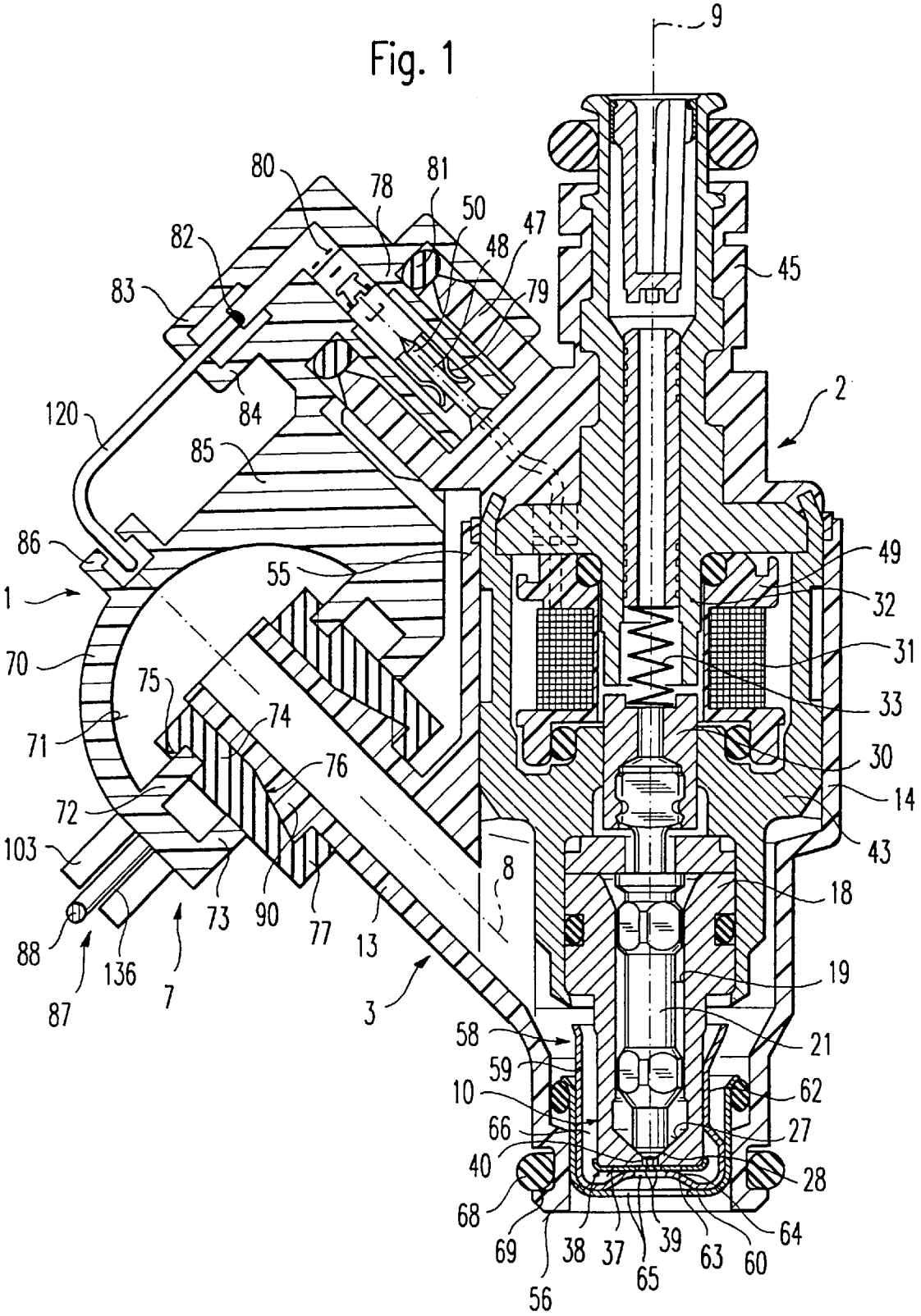
Figure 4:
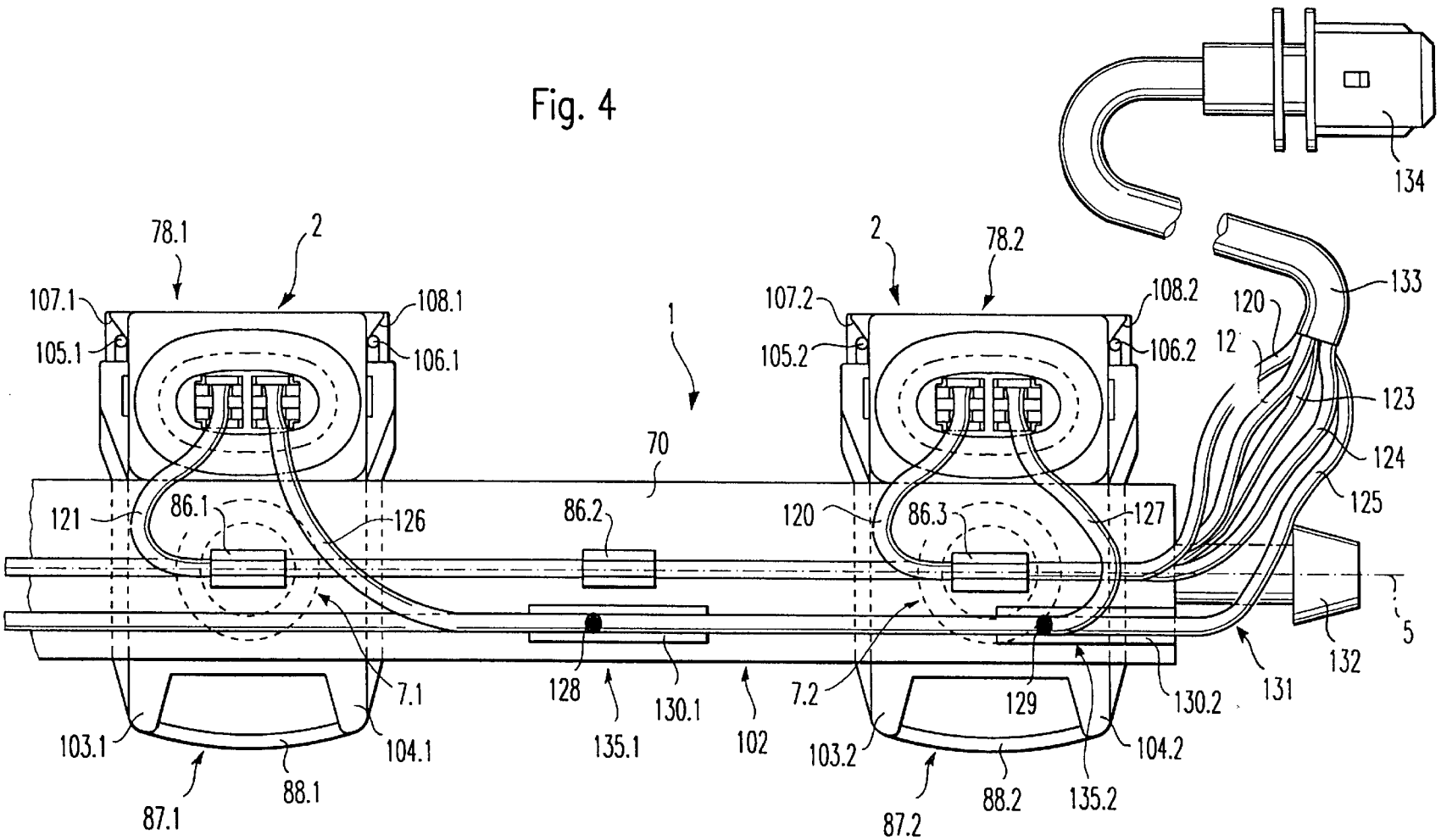

FIG. 1 shows partially and as an example a distributor device 1 for fuel injection systems of internal combustion engines with spark ignition and compression of a mixture for joint gas supply and electric contacting of at least two fuel injection valves 2. Connection of distributor device 1 and fuel injection valve 2, which is necessary for the supply of gas to the respective fuel injection valve 2, is guaranteed by a gas-encompassing body 3 which mostly surrounds the fuel injection valve 2. Distributor device 1, which may be elongated, for example, has connecting parts 7 with which the connection to gas-encompassing body 3 can be established and which are designed with a constant spacing between one another along a longitudinal distributor axis 5, which runs perpendicular to the plane of the drawing in FIG. 1 and is shown in FIG. 4, where the number of the connecting parts corresponds to the number of fuel injection valves 2 to be supplied with a gas. Connecting parts 7 of distributor device 1 each extend along an axis 8 of the gas inlet channel which runs, for example, perpendicular to the longitudinal distributor axis 5 of distributor device 1. In FIG. 4, the elongated shape of distributor device 1 and the arrangement of the connecting parts 7 can be seen especially clearly.

Fuel injection valve 2 runs together with the gas-encompassing body 3 along a valve longitudinal axis 9 which is not perpendicular to the axis 8 of the gas inlet channel, where the gas-encompassing body 3 comprises at least one valve end 10 of fuel injection valve 2. Gas-encompassing body 3 is formed by a gas inlet channel 13, which is designed like the connecting part 7 of distributor device 1 to be concentric with axis 8 of the gas inlet channel, and a tubular stepped encompassing jacket 14 which surrounds fuel injection valve 2 radially over a large portion of its axial extent. The following short description of fuel injection valve 2 is to be understood only as an example, because completely different types of valves which are to be gas encompassed, can also be equipped with gas-encompassing body 3 and can be connected to the distributor device 1 according to this invention.

Fuel injection valve 2 shown in FIG. 1, which can be operated electromagnetically, for example, has a nozzle body 18 extending to the valve end 10 as part of a valve casing. A stepped longitudinal bore 19 is formed in nozzle body 18, running concentrically to the longitudinal axis 9 of the valve and arranged in valve closing part 21 which is needle-shaped, for example. Valve closing part 21 has two guide sections, for example, which together with the wall of longitudinal bore 19 of nozzle body 18 serve to guide the valve closing part 21. In its downstream end, the longitudinal bore 19 of nozzle body 18 has a valve seat 27 which tapers in the form of a truncated cone in the direction of the fuel flow; together with a sealing section 28 (which tapers in a truncated cone in the direction of fuel flow) of valve closing body 21, the valve seat forms a seat valve. On the end facing away from sealing section 28, valve closing part 21 is connected to a tubular armature 30 which works together with a solenoid 31, which partially surrounds armature 30 in the axial direction, and a tubular internal pole 32 of fuel injection valve 2 opposite armature 30 on the side opposite the fixed valve seat 27. A restoring spring 33 which is on the end of valve closing part 21 connected to armature 30 tends to move valve closing part 21 in the direction of fixed valve seat 27.

A spray-orifice plate 38 is in direct contact with a downstream end face 37 of valve end 10 of fuel injection valve 2. Spray-orifice plate 38 has, for example, two or four spray orifices 39 through which is sprayed fuel, which flows past valve seat 27 when valve closing part 21 is raised and enters an end channel 40 of longitudinal bore 19 facing the spray orifices 39.

The valve casing of fuel injection valve 2 also includes a valve jacket 43, which is made of a ferromagnetic material, for example, and radially surrounds solenoid 31, extending axially from internal pole 32 to nozzle body 18, and is connected to both parts.

Internal pole 32 and valve jacket 43 are at least partially enclosed by a plastic sheathing 45 in the axial direction. An electric plug 47 by means of which solenoid 31 is contacted electrically and thus energized is molded together with plastic sheathing 45, for example. Plug 47 made of plastic includes, for example, two metal contact pins 48 which are connected directly to the winding of solenoid 31. Contact pins 48 project out of a coil mount 49, which is made of plastic and surrounds solenoid 31, and they are sheathed mostly in plastic. Contact pins 48 are exposed only at the end 50 of each pin, thus permitting a plug connection with a corresponding bushing 78 of distributor device 1.

At its upper end 55 which faces plug 47, encompassing jacket 14 of gas-encompassing body 3 is fixedly and tightly attached to fuel injection valve 2, encompassing valve jacket 43 in radial contact with it in the area of the end of coil mount 49 facing plug connector 47. The tight connection between gas-encompassing body 3 and fuel injection valve 2 is accomplished, for example, by pressing and/or ultrasonic welding of the encompassing jacket 14 of the gas-encompassing body 3 with its end 55 on the circumference of the valve jacket 43 of fuel injection valve 2, without requiring a sealing element. Tubular gas inlet channel 13 which belongs to gas-encompassing body 3 is concentric with the axis 8 of the gas outlet channel and serves to supply a gas directly to fuel injection valve 2; the gas inlet channel opens into encompassing jacket 14 below (as seen in the direction of fuel flow) the fixed and tight connection between the upper end 55 and a lower end edge 56 of gas-encompassing body 3, so that the gas passing through the gas inlet channel 13 can enter unhindered a pot-shaped gas-encompassing sleeve 58 arranged between encompassing jacket 14 and valve end 10.

With a cylinder part 59, gas-encompassing sleeve 58 surrounds valve end 10 of the fuel injection valves 2 at least partially axially, and with a bottom part 60 it surrounds the valve end at least partially radially. In this embodiment, gas-encompassing sleeve 58 is designed in two parts, with an inside pot and an outside pot made of sheet metal or plastic, for example. The outside pot serves mainly a sealing function in gas-encompassing body 3, while the inside pot has an aligning function due to bracket sections 62 projecting from cylinder part 59 to nozzle body 18, and it has a gas-metering function due to radial section 63 which projects from bottom part 60 to spray-orifice plate 38. An annular gas clearance 64 is formed between spray-orifice plate 38 and radial section 63 of bottom part 60 and is secured by spacer elements such as nubs, for example, that come into contact with spray-orifice plate 38. Both the inside pot and the outside pot have through-holes 65 running concentrically with the longitudinal axis 9 of the valve in the bottom part 60 of the gas-encompassing sleeve 58. Thus, the gas passes through the gas inlet channel 13 into an annular gas channel 66, which is bordered radially by the wall of cylinder part 59 of the inside pot and the circumference of nozzle body 18 of fuel injection valve 2, and reaches as far as annular gas clearance 64. The axially tight, annular gas clearance 64 which is formed radially between spray-orifice plate 38 and radial section 63 of bottom part 60 serves to supply the gas to the fuel delivered through spray orifices 39 and to meter the gas. Due to the small axial dimension of the tight annular gas clearance 64 in the direction of longitudinal valve axis 9, the gas supplied is greatly accelerated and thus produces an especially fine atomization of the fuel, thereby reducing pollutant emission by the combustion engine. The mixture of fuel and gas ultimately comes out of gas-encompassing sleeve 58 through through-holes 65, and thus comes out of fuel injection valve 2.

An acute angle is formed by longitudinal valve axis 9 and axis 8 of the gas inlet channel. The angle of the gas inlet channel 13 to the longitudinal valve axis 9 can be varied with different gas-encompassing bodies 3 in accordance with the demands in the internal combustion engine and the design of distributor device 1 according to this invention.

Gas-encompassing body 3 with its encompassing jacket 14 axially and radially adjacent to gas inlet channel 13 is designed like the outside contour of fuel injection valve 2. Gas inlet channel 13 and encompassing jacket 14 are made of a plastic having a high thermal stability and good dimensional stability, so that ultrasonic welding can be used as the joining method. A gasket 68 is arranged in an annular groove 69 provided between gas inlet channel 13 and the end edge 56 on encompassing jacket 14. It serves to provide a seal between the circumference of the gas-encompassing body 3 and a valve receptacle (not shown) which may be provided on the intake manifold, for example, of the internal combustion engine.

To supply gas to fuel injection valves 2, the distributor device 1 according to this invention has a gas supply line 70 running along the longitudinal distributor axis 5 in which there is a supply orifice 71 which also runs along the longitudinal distributor axis 5. The cross section of supply orifice 71 is arc shaped in this embodiment, but other designs of the cross section of supply orifice 71, in particular in the form of a full circle, are also conceivable. The required cross-sectional area of the supply orifice depends on the number of fuel injection valves 2 to be supplied and the amount of gas volume required. In the embodiment shown here, the connecting parts 7 which serve to establish the connection with gas inlet channels 13 of fuel injection valves 2 have a holding section 72 which runs perpendicularly from the wall of gas supply line 70 and preferably runs around axis 8 of the gas inlet channel and they also have a supporting section 73 surrounding axis 8 of the gas inlet channel. Holding section 72 serves to accommodate a sealing body 74, which is essentially a hollow cylinder in this embodiment and has a groove 75 in the area of holding section 72, so that holding section 72 engages with and locks into the groove. Sealing body 74 is preferably made of an elastic material such as rubber, and therefore can undergo elastic deformation in assembly and dismantling.

Gas inlet channel 13 has at least one locking element in the form of a radial projection 90 which has a sawtooth shape in the present embodiment and expands at first continuously along the axis 8 of the gas inlet channel in the direction of longitudinal axis 9 of fuel injection valve 2 and then tapers abruptly. Sealing body 74 has a corresponding annular groove 76. When the front section of gas inlet channel 13 is inserted into sealing body 74, projection 90 therefore engages in the groove 76 of sealing body 74 without applying any great force, as the end section 77 of sealing body 74 which faces the fuel injection valve 2 snaps behind projection 90 of the gas inlet channel 13. Therefore, a much greater force is needed to release the connection between gas inlet channel 13 and connecting section 7 of the distributor device 1 than to join these parts, so this safeguards the connection against withdrawal. The withdrawal force is increased by the fact that supporting section 73 radially surrounds the sealing body 74 in the area of groove 76, and thus counteracts any radial expansion of elastic sealing body 74 in this area. Therefore, the radial strain on the elastic sealing body 74 is increased and the connection between sealing body 74 and gas inlet channel 13 is improved.

Projection 90 and groove 76 may also be designed with an arc shape or a wavy shape or may otherwise be provided with radii. Gas inlet channel 13 may have a plurality of sawtooth-shaped projections 90 which are offset axially with respect to axis 8 of the gas inlet channel in the area of sealing body 74 and work together with corresponding annular grooves of sealing body 74 which are also offset axially. In this way, the withdrawal force may be further increased as needed.

A bushing 78 is molded on gas supply line 70 for each fuel injection valve 2 to be supplied according to this invention. Bushings 78 are preferably manufactured in one piece with gas supply line 70, for example, as an injection molded plastic part. However, it is also conceivable to manufacture bushings 78 separately from gas supply line 70 and to subsequently join the gas supply line 70 to bushings 78 by welding, for example. From the standpoint of manufacturing technology, however, the one-part design has the advantage that the gas supply line 70 and bushing 78 may be produced in a single operation by using one plastic injection mold.

Electric contact with contact pins 48 is established by means of contact springs 79 by pushing bushing 78 onto plug 47 of a fuel injection valve 2. Each contact spring 79 is electrically connected to a respective connector element 80, which is bent at a right angle in the example illustrated here. A separate contact spring 79 and a respective connector element 80, which are arranged perpendicular to the plane of the drawing and offset to one another, are provided for each contact pin 48 of plug 47 in bushing 78. Each bushing 78 has a sealing element 81 which seals bushing 78 with respect to plug 47 to prevent the penetration of splashing water and thus to prevent corrosion of contact pins 48 and contact springs 79.

A plurality of electric supply lines 120–125 can be connected to each connector element 80 of bushing 78. The connection between the electric supply line 120 shown in FIG. 1 and the connector element 80 can be established, for example, by soldering, welding or the like at a contact point 82. In this embodiment, an upper strap 83 of bushing 78 can be swung up so that contact point 82 for contacting is accessible. By connecting the upper strap 83 to lower strap 84, a cover for contact point 82 that is protected from splashing water can be achieved subsequently to prevent corrosion at contact point 82. As an alternative, it is also possible to establish the connection of the individual supply lines 120–125 with bushing 78 by means of a single-core plug connection. The gas supply line 70 becomes thicker, forming a supporting body 85 in the direction of bushings 78, thus forming a stable design of distributor device 1 on the whole. Clamping elements 86 which are provided on the top of the wall of the gas supply line serve to form a cable guide for electric supply lines 120–125, as shown in detail in FIG. 4.

In assembling the distributor device 1 according to this invention on the fuel injection valves 2, sealing body 74 not only has a sealing function but also has the additional function of compensating the tolerance. This compensation of tolerance is necessary because the distance between bushings 78 and the central axis of connecting parts 7 on the one hand and the distance between plugs 47 and axis 8 of the gas inlet channels of the fuel injection valves 2 on the other hand varies within a very narrow tolerance range due to manufacturing variations. These variations are compensated by sealing body 74 due to its elastic nature, which results in a floating mount of gas inlet channels 13 of fuel injection valves 2 in the distributor device 1 according to this invention. This greatly facilitates assembly and even permits automatic assembly.

Furthermore, an operating device 87 is molded on the gas supply line 70 for each bushing 78; a locking spring in the form of a spring wire 88 which locks bushing 78 on plug 47 can be loosened with the operating device, as discussed in greater detail below with reference to FIGS. 2 and 3.

Figure 2:
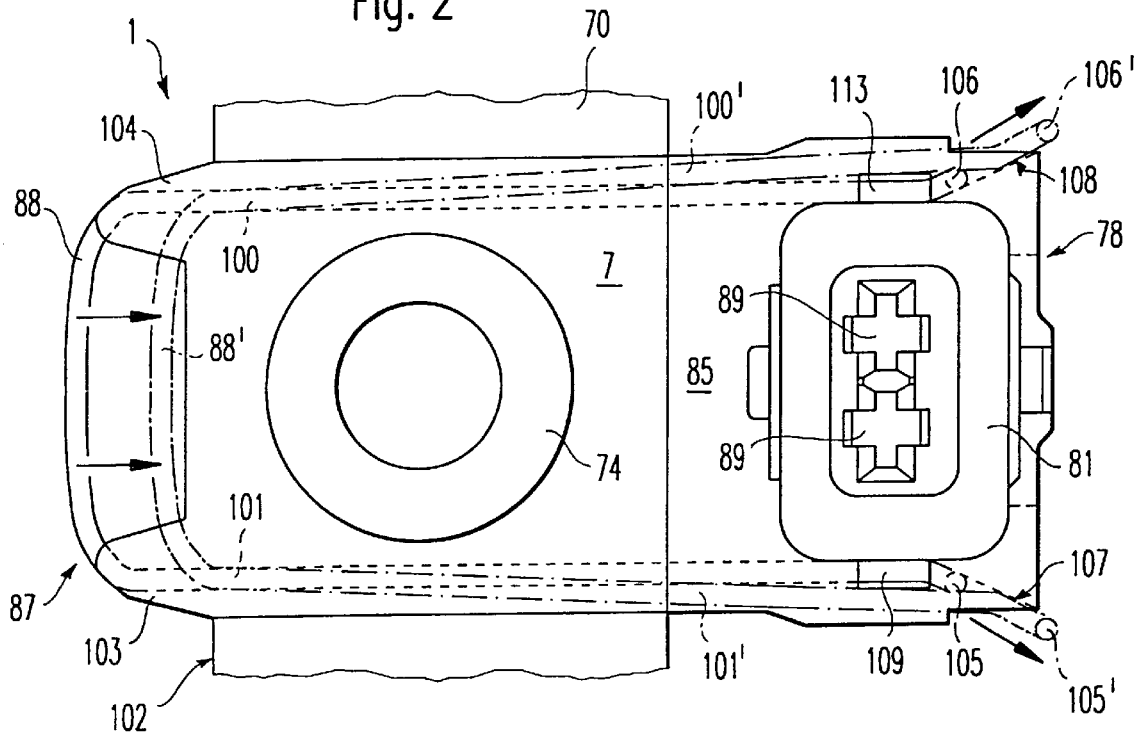

FIG. 2 shows a view of distributor device 1 according to this invention in the area of a connecting part 7 and in the area of a bushing 78, as seen from the side of fuel injection valve 2.

FIG. 2 shows the sealing bodies 74 of the connecting part 7 of the gas supply line 70 and sealing element 81 of bushing 78. Furthermore, this shows recesses 89 into which the contact springs 79 shown in FIG. 2 can be inserted.

According to this invention, for each fuel injection valve 2 is provided an elastically deformable locking spring, which in its undeformed state locks the connection of bushing 78 to plug 47 of the respective fuel injection valve 2 and in its deformed state releases the connection of bushing 78 with plug 47 of the respective fuel injection valve 2. In the embodiment shown here, the locking spring is designed as a spring wire 88 bent essentially in a U shape. The two legs 100, 101 of spring wire 88 extend across the longitudinal extent of the gas supply line 70, from the area of bushing 78 to the respective operating device 87. Operating devices 87 are arranged on the side 102 of gas supply line 70 which faces away from bushings 78.

Each operating device 87 has two projections 103, 104, each of which is provided with a slot 136 (shown in FIG. 1) to guide the spring wire 88. Spring wire 88 which is guided in slots 105 in projections 103, 104 is freely accessible in the area between projections 103, 104. In the area between projections 103, 104, spring wire 88 may be pushed in the direction of bushing 78, e.g., by the action of a manual operating force, as indicated by the arrows in FIG. 2. The location of spring wire 88 in its displaced position is indicated by a dash-dot line in FIG. 2. Ends 105 and 106 of legs 100, 101 of the U-shaped spring wire 88 slide along an inclined face 107, 108 of bushing 78 facing outward at an inclination. For illustration purposes, the legs of the displaced spring wire 88' are labeled with reference notation 100' and 101', while the ends of the legs are labeled with reference notation 105' and 106' in their displaced position. By displacing the spring wire 88, the ends 105, 106 of the legs 100, 101 are pushed outward, as indicated by the arrows in FIG. 2, so that legs 100, 101 of spring wire 88 are spread apart. As shown in FIG. 2, one of legs 100, 101 covers one of the two guide grooves 109, 113 which are arranged in the side area of bushing 78 and extend perpendicular to the plane of the drawing, in the basic position of spring wire 88 shown with broken lines. However, legs 100', 101' in the displaced position of spring wire 88' indicated with dash-dot lines in FIG. 2 are spread apart so far that they release the guide grooves 109, 113.

Figure 3:
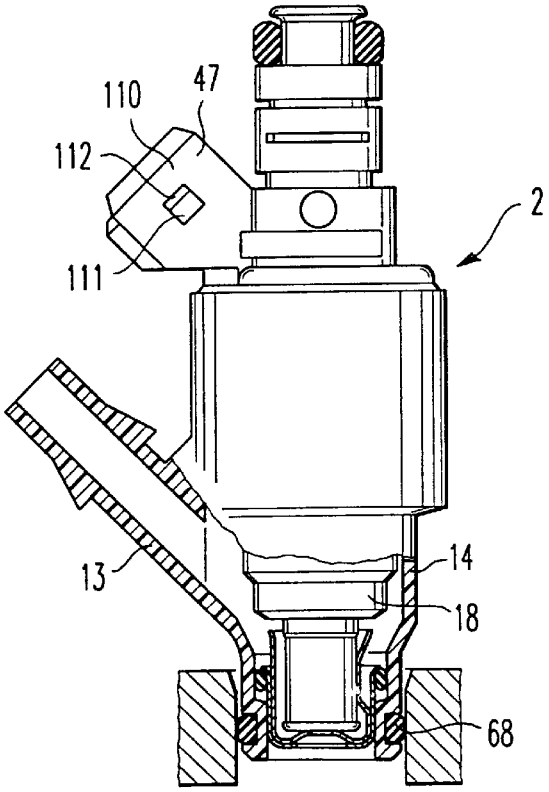

FIG. 3 shows a partially cutaway schematic diagram of a fuel injection valve 2, which is essentially identical in design to the fuel injection valve 2 shown in FIG. 1. Plug 47, which is not shown in a sectional view in FIG. 3, has on each side area 110 a guide lug 111 which engages in one of the guide grooves 109, 113 when joining plug 47 to bushing 78 of the distributor device 1 according to this invention. Guide lug 111 may have a chamfered end face 112 which pushes legs 100, 101 of spring wire 88 apart when joining plug 47 and bushing 78, so that spring wire 88 need not be operated in assembly. In the assembled state, a guide lug 111 which is guided in guide grooves 109, 113 engages behind one of legs 100, 101 of spring wire 88, so that spring wire 88 locks the connection of bushing 78 with plug 47 in its undeformed state (shown with broken lines in FIG. 2). When spring wire 88 is displaced into its deformed state (shown with dash-dot lines in FIG. 2) by exerting an operating force on spring wire 88 in the area between projections 103, 104, legs 100', 101' which are displaced accordingly release guide grooves 109, 113 accordingly, so that bushing 78 can be separated from plug 47.

The arrangement of the operating device 87 on the side 102 of the gas supply line 70 facing away from bushing 78 has the advantage that accessibility of operating device 87 is not hindered by fuel injection valve 2. This also yields an especially space-saving overall arrangement. At the same time, the arrangement of operating device 87 according to this invention has the advantage that it is arranged in the immediate vicinity of gas inlet channel 13 and sealing body 74 of connecting part 7. Therefore, distributor device 1 designed according to this invention can be released from fuel injection valve 2 with a single operation in that spring wire 88 is displaced in the area of operating device 87, as shown in FIG. 2, and also end section 77 of sealing body 74 is deformed so that the gas inlet channel 13 can be pulled out of the sealing body 74. Sealing body 74 is thus enclosed in holding section 72. After assembly on fuel injection valve 2, end section 77 holds the bead 90 and the connection can be released again with no problem.

It is of course also conceivable for sealing body 74 to be fixedly connected to gas inlet channel 13 and to connecting part 7 by means of a catch connection.

FIG. 4 shows a top view of distributor device 1 according to this invention, as seen on the side facing away from fuel injection valves 2 in a detail drawing, showing bushings 78.1 and 78.2 which are molded on the gas supply line 70. Respective operating devices 87.1 and 87.2 are each on the opposite side of gas supply line 70. The number of bushings 78.1, 78.2 and the number of connecting parts 7.1, 7.2 corresponds to the number of fuel injection valves 2 to be provided on the combustion engine. Gas supply line 70 is lengthened on the left edge of the drawing to the extent that it reaches all the fuel injection valves 2. For the present embodiment, it is assumed that a total of four fuel injection valves 2 are provided. However, for reasons of simplicity, only two bushings 78.1 and 78.2 and two connecting parts 7.1 and 7.2 are shown here.

The embodiment of bushings 78.1 and 78.2 is modified in comparison with the embodiment shown in FIG. 1 inasmuch as the contacting of connector elements 80 with electric supply lines 120 through 125 does not take place at the side but instead from above. Furthermore, bushings 78 are molded directly on gas supply line 70 without any intermediate supporting body (85 in FIG. 1).

A separate electric supply line 120 through 124 leads to each bushing 78.1, 78.2. The electric supply lines 120–124 are guided in clamping elements 86.1 through 86.3 which are molded on the top side of gas supply line 70. Clamping elements 86.1 through 86.3 allow flexible and rapid installation of electric supply lines 120–124. All bushings 78.1, 78.2 are connected to a common electric supply line 125, which forms the ground line, for example. Accordingly, branch lines 126 and 127 which lead to the individual bushings 78.1, 78.2 are connected to the common electric supply line 125 at contact points 128, 129, e.g., by soldering or welding. According to an embodiment according to this invention, the lines at branching points 135.1, 135.2 may be laid in pan-shaped elements, preferably receptacles 130.1 and 130.2, which are cast with a hard-setting plastic resin after establishing the electric contact. This yields a mechanical fixation and electric insulation at the same time.

The flexible locking of electric supply lines 120–125 shown in FIG. 4 serves to compensate the tolerance at the same time, thereby counteracting any damage to electric supply lines 120–125 which might be caused by a rigid mount. However, the electric supply lines 120–125 may also be guided in some other way. For example, flexible printed conductors applied to a film may be provided, or the electric supply lines may be cast in the wall of gas supply line 70.

At its open end 131, gas supply line 70 has a connection 132 through which the gas medium, e.g., filtered air, is supplied to the gas supply line 70. Electric supply lines 120–125 may be combined into a cable conduit 133 and led to a joint connector socket 134. Connector socket 134 can be inserted into an electric control unit, for example, for driving fuel injection valves 2.

The invention is not limited to the embodiments presented here. For example, the elastically deformable locking spring may also be implemented otherwise, e.g., by a plate spring or a flexible plastic part. Furthermore, a number of other known plug and bushing forms may also be used within the scope of the present invention.

We claim:

1. Distributor device for fuel injection systems for internal combustion engines for supplying gas and for electric contacting of at least two fuel injection valves that serve to inject a fuel-gas mixture to a gas supply line for the joint gas supply of the fuel injection valves, having a supply orifice and a number of connecting parts corresponding to the number of fuel injection valves for connecting the supply orifice to gas inlet channels of the fuel injection valves, and having a number of bushings arranged along the gas supply line corresponding to the number of fuel injection valves, the bushings working together with plugs provided on the fuel injection valves to establish electric contact with the fuel injection valves, characterized in that a locking spring (88) is provided for each bushing (78) to lock the connection of the bushing (78) to the plug (47) of the respective fuel injection valve (2), and an operating device (87) is provided on the side (102) of the gas supply line (70) facing away from the bushings (78) for releasing the locking spring (88), and each locking spring (88) runs across the longitudinal extent of the gas supply line (70) up to the respective operating device (87).

2. Distributor device according to claim 1, characterized in that the locking springs are each designed as an essentially U-shaped spring wire (88), and the bushings (78) have inclined faces (107, 108) in the area of the ends (105, 106) of the spring wire (88), the inclined faces being arranged so that the legs (100, 101) of the U-shaped spring wire (88) are spread apart when the spring wire (88) is pushed toward the bushings (78) to that its ends (105, 106) slide along the inclined faces (107, 108).

3. Distributor device according to claim 2, characterized in that at least one guide groove (109, 113) is provided on each bushing (78) to accommodate a guide lug (111) provided on the plug (47) of the respective fuel injection valve (2), and in its undeformed state (88) the spring wire (88) closes the guide groove (109, 113) and in its deformed state (88') it releases the guide groove (109, 113).

4. Distributor device according to claim 3, characterized in that a guide groove (109, 113) is provided for each leg (100, 101) of the U-shaped spring wire (88).

5. Distributor device according to one of claims 2 through 4, characterized in that the operating device (87) has two projections (103, 104) arranged on the gas supply line (70), and the spring wire (88) is guided in the projections so that it runs at a distance from the gas supply line (70) in the area between the projections (103, 104).

6. Distributor device according to claim 5, characterized in that the projections (103, 104) each have a slot (105) for guiding the spring wire (88).

7. Distributor device according to one of claims 1 through 6, characterized in that the connecting parts (7) each have a sealing body (74) made of an elastic material which surrounds the gas inlet channels (13) at least partially radially after being inserted into the connecting parts (7).

8. Distributor device according to claim 7, characterized in that the sealing bodies (74) each have a groove (76) in which engages a radial projection (90) on the gas inlet channels (13) when inserted into the connecting parts (7).

9. Distributor device according to claim 8, characterized in that the projections (90) are designed as sawtooth shaped.

10. Distributor device according to one of claims 1 through 9, characterized in that clamping elements (86) are provided on the outside of the wall of the gas supply line (70) to accommodate electric supply lines (120–125) which are connected to the bushings (78).

11. Distributor device according to claim 10, characterized in that at least one of the electric supply lines (125) branches off at branching points (135) to all bushings (78), and pan-shaped elements (130) are molded on the distributor device (1) at the branching points (135) to accommodate contact points (128, 129) formed at the branching points (135), the elements being cast with a hard-setting plastic resin so that the contact points (128, 129) are electrically insulated.

12. Distributor device according to claim 10 or 11, characterized in that the electric supply lines (120–125) are combined into a cable conduit (133) at one end of the distributor device (1) and are connected to a joint plug (134).

13. Distributor device according to one of claims 1 through 12, characterized in that the gas supply line (70) has one open end (131) with a connection (132), while the opposite end of the gas supply line (70) is sealed.

* * * * *